US008647053B2

(12) United States Patent
Hsu et al.

(10) Patent No.: US 8,647,053 B2
(45) Date of Patent: Feb. 11, 2014

(54) COOLING ARRANGEMENT FOR A TURBINE COMPONENT

(75) Inventors: Johan Hsu, Orlando, FL (US); Jay A. Morrison, Cocoa, FL (US)

(73) Assignee: Siemens Energy, Inc., Orlando, FL (US)

( * ) Notice: Subject to any disclaimer, the term of this patent is extended or adjusted under 35 U.S.C. 154(b) by 777 days.

(21) Appl. No.: 12/852,688

(22) Filed: Aug. 9, 2010

(65) Prior Publication Data

US 2012/0034075 A1 Feb. 9, 2012

(51) Int. Cl.
*F01D 25/12* (2006.01)

(52) U.S. Cl.
USPC ..... 415/115; 415/116

(58) Field of Classification Search
USPC ..... 415/115, 116; 416/96 R, 97 R, 97 A; 60/752, 757, 754, 755, 756, 760, 746, 60/39.23, 766, 772, 775
See application file for complete search history.

(56) References Cited

U.S. PATENT DOCUMENTS

| | | | | |
|---|---|---|---|---|
| 3,652,181 | A | 3/1972 | Wilhelm, Jr. | |
| 4,446,693 | A | 5/1984 | Pidcock et al. | |
| 4,695,247 | A * | 9/1987 | Enzaki et al. | 431/352 |
| 4,719,748 | A | 1/1988 | Davis, Jr. et al. | |
| 5,528,904 | A | 6/1996 | Jones et al. | |
| 5,605,046 | A | 2/1997 | Liang | |
| 6,018,950 | A | 2/2000 | Moeller | |
| 6,602,053 | B2 | 8/2003 | Subramanian et al. | |
| 6,837,050 | B2 | 1/2005 | Mandai et al. | |
| 6,964,170 | B2 | 11/2005 | Alkabie | |
| 6,981,358 | B2 | 1/2006 | Belluchi et al. | |
| 7,195,458 | B2 | 3/2007 | Liang | |
| 7,219,498 | B2 | 5/2007 | Hadder | |
| 7,310,938 | B2 | 12/2007 | Marcum et al. | |
| 7,488,156 | B2 | 2/2009 | Liang | |
| 7,694,522 | B2 * | 4/2010 | Nakae et al. | 60/752 |
| 8,147,205 | B2 * | 4/2012 | Digard Brou De Cuissart et al. | 416/223 A |
| 2001/0004835 | A1 | 6/2001 | Alkabie et al. | |
| 2002/0152740 | A1 | 10/2002 | Suenaga et al. | |
| 2006/0130484 | A1 | 6/2006 | Marcum et al. | |
| 2006/0140762 | A1 * | 6/2006 | Pietraszkiewicz et al. | 416/97 R |
| 2006/0210399 | A1 * | 9/2006 | Kitamura et al. | 416/97 R |
| 2008/0276619 | A1 | 11/2008 | Chopra et al. | |
| 2009/0252593 | A1 | 10/2009 | Chila et al. | |
| 2010/0071382 | A1 | 3/2010 | Liang | |
| 2010/0223931 | A1 * | 9/2010 | Chila et al. | 60/760 |
| 2010/0242485 | A1 * | 9/2010 | Davis et al. | 60/752 |
| 2010/0251722 | A1 * | 10/2010 | Woolford et al. | 60/755 |
| 2011/0185739 | A1 * | 8/2011 | Bronson et al. | 60/755 |
| 2011/0247341 | A1 * | 10/2011 | McMahan et al. | 60/757 |

* cited by examiner

*Primary Examiner* — Dwayne J White

(57) ABSTRACT

A cooled component wall (52) with a combustion gas (36) on one side (56) and a coolant gas (48) with higher pressure on the other side (58). The wall includes a cooling chamber (60) with an impingement cooling zone (62), a convective cooling zone (64), and a film cooling zone (66). Impingement holes (70) admit and direct jets (72) of coolant against the wall, then the coolant passes among heat transfer elements such as channels (76) and fins (78) to the film cooling zone (66) where it passes through holes in the wall that direct a film of the coolant along the combustion side of the wall. The chamber may be oriented with the impingement zone (62) downstream and the film cooling zone (66) upstream, relative to the combustion gas flow (36). This provides two passes of the coolant (84, 79) in opposite directions over the respective opposite sides of the wall (56, 58).

20 Claims, 6 Drawing Sheets

COOLING ARRANGEMENT FOR A TURBINE COMPONENT

FIELD OF THE INVENTION

This invention relates to cooling of turbine component walls using a cooling fluid, such as on a gas turbine duct.

BACKGROUND OF THE INVENTION

Components such as combustor-to-turbine transition ducts that are in combustion gas flow areas of gas turbines require cooling to maintain design temperatures. Cooling efficiency is important in order to minimize the usage of air diverted from the compressor for cooling. Impingement cooling is a technique in which a perforated wall is spaced from a hot wall to be cooled. Cooling air flows through the perforations and forms jets that impinge on the hot wall. However, the impinged air then flows across the wall surface, interfering with other impingement jets. This is called "cross-flow interference" herein. Other cooling techniques use elements such as cooling channels, fins, and pins to provide increased surface area for convective/conductive heat transfer. However, the coolant becomes warmer with distance, reducing uniformity of cooling. Film cooling provides an insulating film of cooling air on a hot gas flow surface via holes through the wall from a coolant supply. This can be effective, but uses a high amount of coolant.

Combinations of cooling techniques have been used, as exemplified by US Patent Application Publication No. US 2008/0276619 A1, which teaches a cooling channel having a plurality of impingement jet inlets and a plurality of outlets. However, as the combustion temperatures in advanced turbine designs continue to increase, there is an ongoing need for improved cooling arrangements.

BRIEF DESCRIPTION OF THE DRAWINGS

The invention is explained in the following description in view of the drawings that show.

DETAILED DESCRIPTION OF THE INVENTION

In one embodiment, the present invention combines an impingement cooling zone chamber, a convective heat transfer zone with multiple channels, and a film cooling zone chamber leading to plurality of metering film cooling outlets, in a way that provides more flexible independent optimization of each zone and a higher degree of synergy and complementation among the zones that maximizes cooling efficiency and uniformity.

Figure 1:
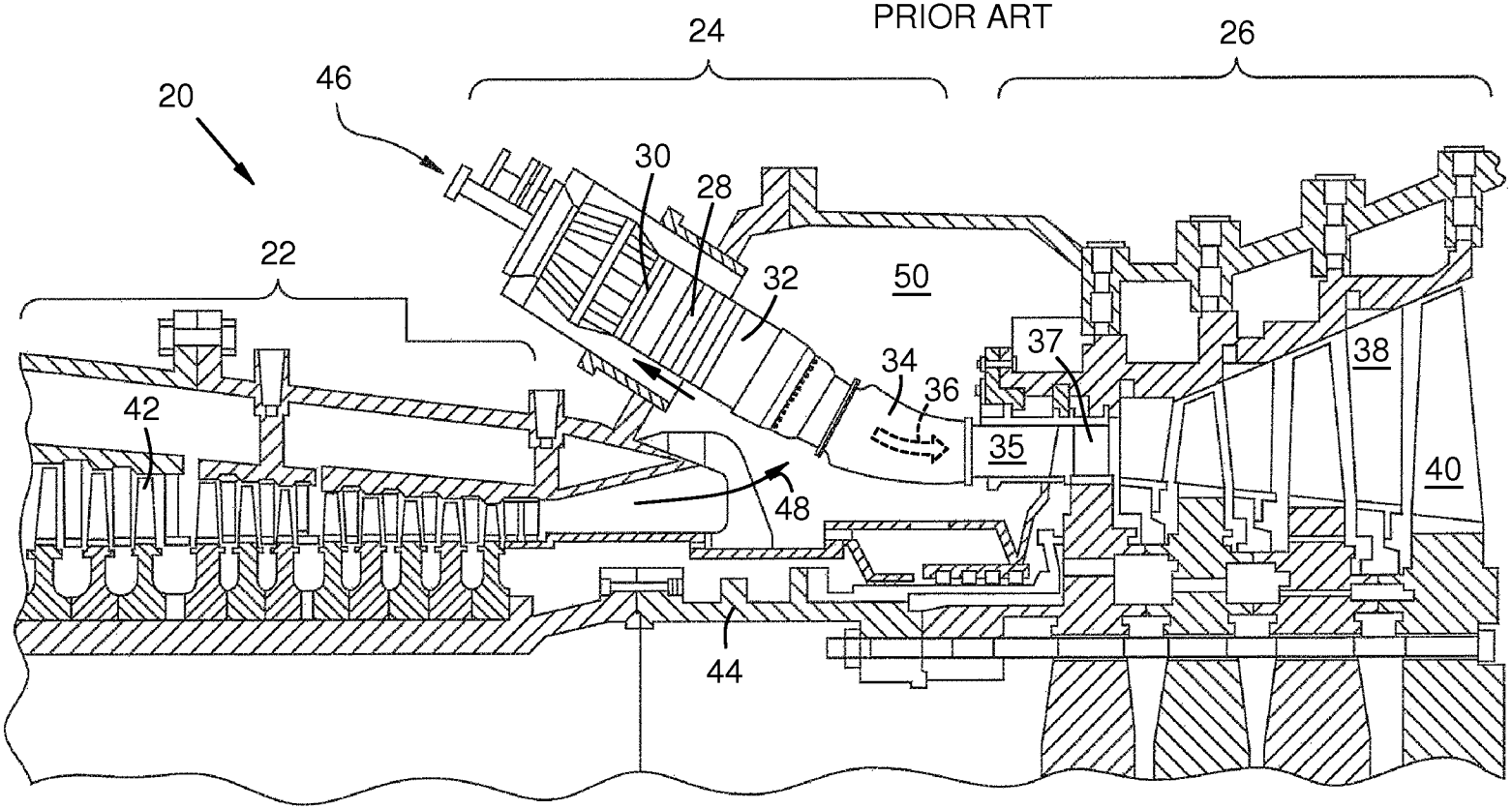
FIG 1 PRIOR ART
FIG. 1 is a prior art partial side sectional view of a gas turbine engine.

FIG. 1 is a partial side sectional view of a gas turbine engine 20 with a compressor section 22, a combustion section 24, and a turbine section 26 as known in the art. Each combustor 28 has an upstream end 30 and a downstream end 32. A transition duct 34 and an intermediate exit piece 35 transfer the combustion gas 36 from the combustor to the first row of airfoils 37 of the turbine section 26. The first row of airfoils 37 may be stationary vanes 38 or rotating blades 40, depending on the turbine design. Compressor blades 42 are driven by the turbine blades 40 via a common shaft 44. Fuel 46 enters each combustor. Compressed air 48 enters a plenum 50 around the combustors. It enters the upstream end 30 of the combustors, and is mixed with fuel for combustion. It also surrounds the combustor 28 and the transition duct 34 to provide cooling air. It has a higher pressure than the combustion gas in the combustor and in the transition duct.

Figure 2:
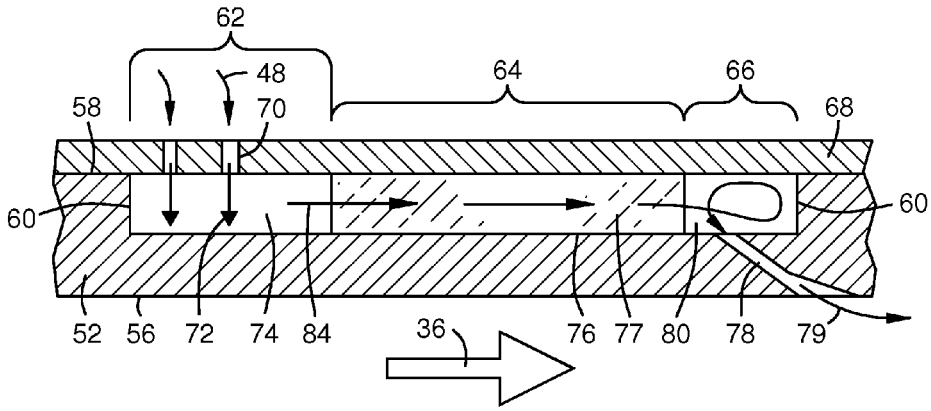
FIG. 2 is a side sectional view of a cooling chamber per aspects of the invention.

FIG. 2 shows a cooling arrangement for a wall 52 of a component such as a transition duct, where there is a combustion gas flow 36 on a first side 56 of the wall, and a coolant gas 48 with a higher pressure on a second side 58 of the wall. A chamber 60 in the wall has an impingement cooling zone 62, a convection cooling zone 64, and a film cooling zone 66. Impingement holes 70 admit and direct jets 72 of the coolant against the wall 52 within an impingement cooling plenum 74 that is a portion of the chamber 60. A cover plate 68 may be used to at least partially define the chamber 60 and to receive the holes 70. The convection cooling zone 64 may have channels 76, fins 77, pins, or other convection/conduction heat transfer elements. Film cooling holes 78 pass through the wall 52 between a film cooling plenum 80 and the first side 56 of the wall to direct a film 79 of the coolant gas along the first side 56 of the wall. The film cooling holes 78 may be flared to spread and slow the film coolant 79. A coolant flow 84 within the chamber defines a lengthwise direction of the chamber.

The cooling zones 62, 64, 66 may be independent of each other, as shown, in which case the impingement holes 70 and film cooling holes 78 are not within the channels 76, or within or beside the heat transfer elements 76, 77. A benefit of this independence is that each zone can be independently optimized. This allows each zone to be designed for efficiency within itself in addition to complementation in the sequence of zones to achieve a desired cooling rate profile along the length of the chamber, as later described in more detail.

The counts of impingement holes 70, channels 76, and film cooling holes 78 may be different from each other. They may be selected in combination with sizes of the heat transfer elements 76, 78 for optimum cooling of each zone, for example to provide optimum flow speeds in the holes and convection cooling elements.

Figure 3:
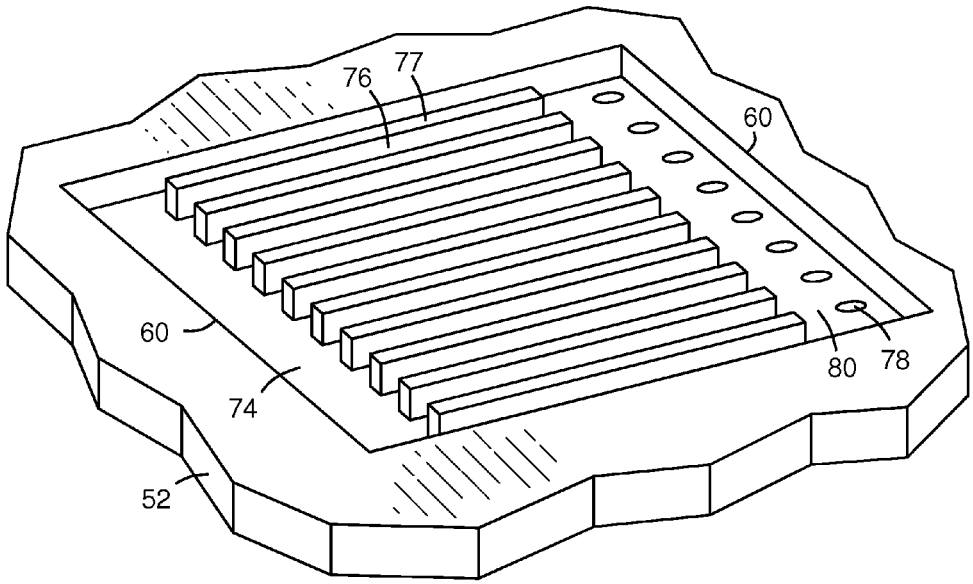
FIG. 3 is a perspective view of a cooling chamber with the cover plate removed.

FIG. 3 is a perspective view of the chamber 60 in a wall 52, with the cover plate 68 removed. It shows an impingement cooling plenum 74, channels 76, fins 77, a film cooling plenum 80, and film cooling holes 78.

Figure 4:
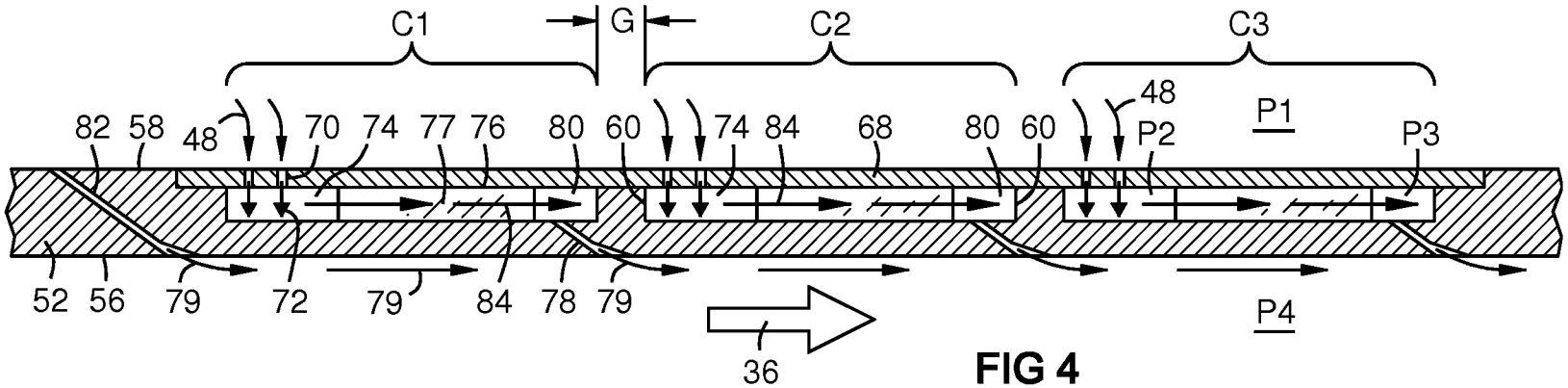
FIG. 4 is a side sectional view of a series of covered cooling chambers.

FIG. 4 is a side sectional view of a wall 52 with a series of chambers C1, C2, C3 with the flow 84 therein aligned with the combustion gas flow 36. Each chamber C1, C2, C3 may be one of multiple chambers in a respective row of chambers aligned transversely to the combustion flow 36. Such rows may partly or fully surround a turbine transition duct 34 or other component. The film cooling holes 78 provide film cooling 79 that at least partially covers the heated first side 56 including in the area of gaps G between the chambers. The film cooling holes 78 also provide conductive/convective cooling through the wall 52 below the film-cooling plenum 80 and the gap G. The film 79 continues along the first side 56 of the wall, and is refreshed and reinforced periodically by subsequent holes 78. A row of additional film cooling holes 82 may be provided upstream of the first upstream row of chambers C1, so that a film 79 covers the wall 52 over the first upstream row of chambers C1. This way, film cooling 79 covers the first side 56 of the wall for every chamber C1, C2, C3.

The channels 76 may be narrow enough to meter the coolant flow 84 and cause a pressure drop across the convection zone 64. This provides four different pressure zones—A first pressure P1 of the cooling air 48 outside the component wall 52, a second pressure P2 in the impingement plenum 74, a third pressure P3 in the film cooling plenum 80, and a fourth pressure P4 of the hot gas flow 36 inside the wall 52. Some prior art designs have only three pressure zones as follows: 1) the coolant air outside the component, 2) in the space between dual walls of the component, and 3) the pressure of the hot gas flow. Providing four pressure zones P1, P2, P3, P4 in the present invention reduces the pressure differential between the cooling air 48 outside the component and within the impingement plenum, and between the film cooling plenum and the hot gas flow 36, thus reducing the coolant mass flow to use coolant more efficiency. For example, the convection and film metering may be designed such that the pressure difference P2-P1 is equal or substantially equal to the pressure difference P4-P3, thus reducing both pressure differences as much as possible.

Coolant metering by the channels 76 increases cooling efficiency in the convection zone, and controls the flow speed through the convection zone. It causes the pressure in the impingement plenum 74 to equalize across the width of the plenum by pausing the flow therein. This equalizes flow among all channels 76 across the width of the convection zone 64. This results in equal coolant temperature across the width of the film cooling plenum, because it has flowed equally through all the channels 76 of the convection zone. Further metering by the film cooling holes 78 causes pressure to equalize in the film cooling plenum, which equalizes flow among the film holes 78 across the width of the film cooling plenum 80. These factors provide widthwise uniformity of cooling across a chamber 60.

The impingement plenum 74 is enclosed by the chamber walls 60 to define a single outflow direction 84 into the convection zone, and thence to the film cooling plenum 80. This directed flow provides uniformity and control of the cooling rate profile because the flow is not subject to random variability. Each chamber C1, C2, C3 can be customized in the above respects to provide a desired cooling level for a given location on the turbine component, depending on conditions of gas pressures P1, P4 and heat at that location.

Figure 5:
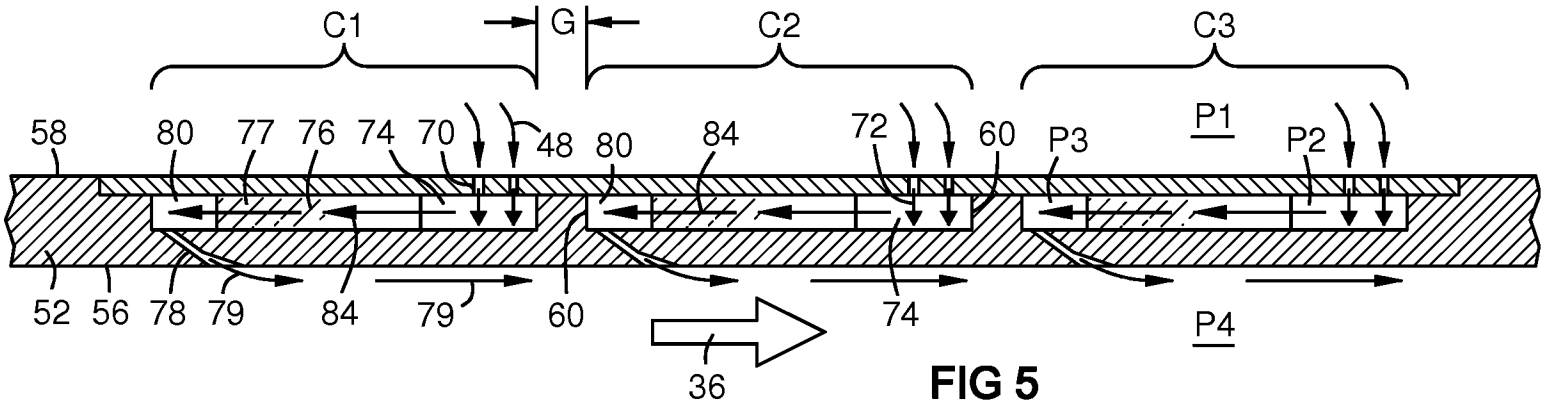
FIG. 5 is a side sectional view of chambers with reverse flow orientation.

FIG. 5 is a view similar to FIG. 4, but the flow orientation of each chamber C1, C2, C3 is reversed relative to a direction of flow of the hot combustion gas flow 36. Here, the coolant flow 84 in each chamber is opposite to the combustion flow 36. Film cooling 79 from each chamber flows immediately back across the chamber. Thus the coolant passes over the first and second sides of the wall 52 in respective opposite directions, with a first pass 84 within the chamber 60, and a second pass 79 on the first side 56 of the wall opposite the chamber. As in FIG. 4, a further upstream row of film-cooling holes 82 may be provided, but this is not shown in FIG. 5 since the upstream chamber C1 is already covered by its own film cooling flow 79.

Figure 6:
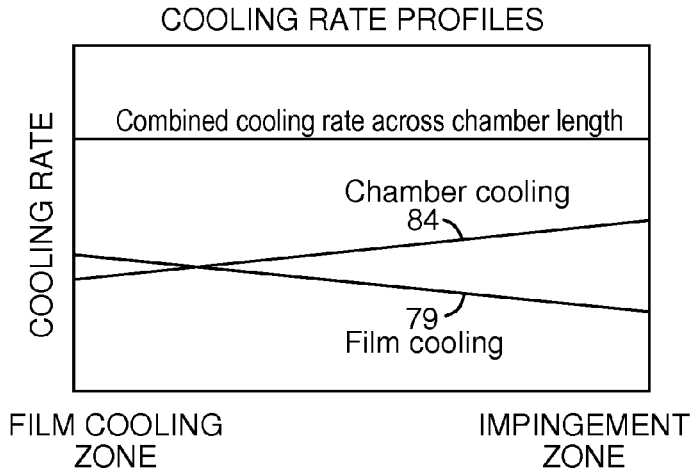
FIG. 6 conceptually shows cooling rate profiles across a chamber of FIG. 5.

FIG. 6 conceptually shows profiles of the chamber cooling rate and the film cooling rate in the embodiment of FIG. 5. Such profiles may have respective maxima at opposite ends of the chamber as shown, so that they complement each other, providing a combined cooling rate profile that is more uniform than either of the other cooling rate profiles 84; 79. The combined cooling rate is more equalized than either of the constituent cooling rates in the flow direction 36 of the combustion gas.

The number, length, and thickness of the fins 77 and the size of the channels 76 controls the cooling rate profile of the convection zone and the temperature rise of the coolant. The coolant temperature in the film cooling zone 80, and metering by the film cooling holes, controls the film cooling profile. Using these design variables, the cooling rate profiles 84, 79 of FIG. 6 may be matched for combined uniform cooling along the full length of each chamber of FIG. 5 without hot spots, allowing maximum spacing between film cooling plenums, further reducing the amount of coolant needed.

Figure 7:
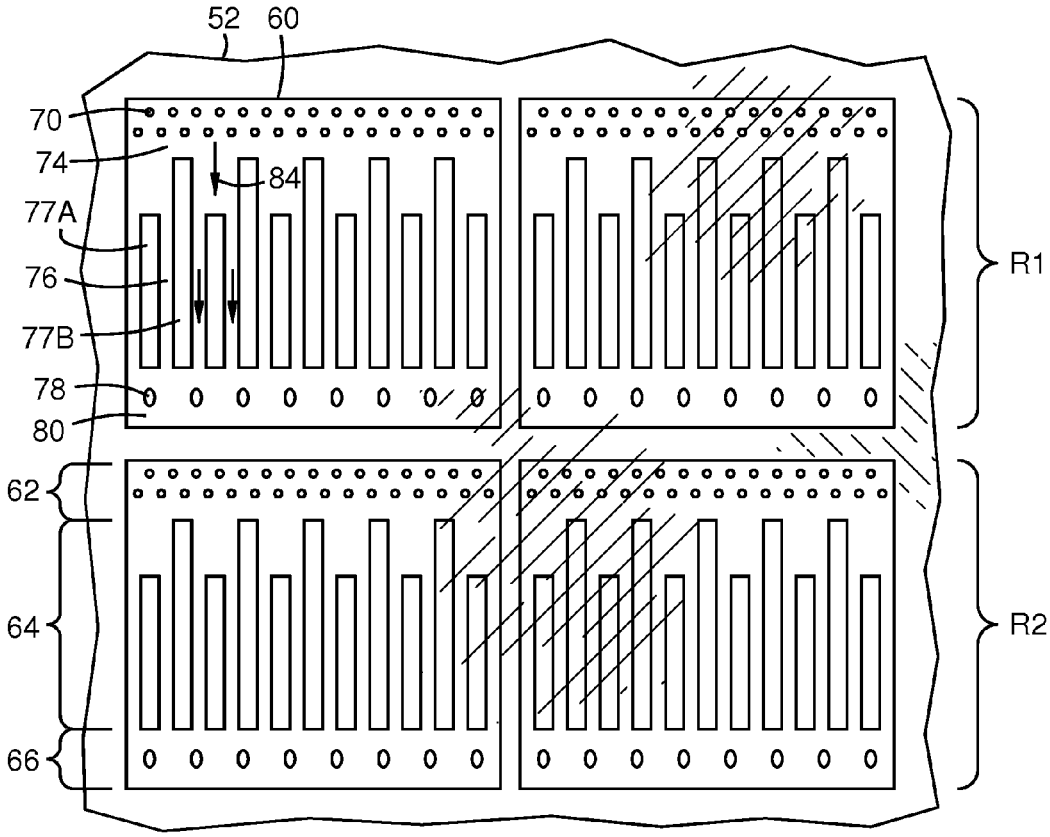
FIG. 7 is a top view of 4 cooling chambers, with cover plate in transparent view.

FIG. 7 is a top view of a panel of four cooling chambers 60 in two rows R1, R2 as if viewed through a transparent cover plate with respective impingement holes 70. The impingement holes 70 may be arranged in one or more rows that are perpendicular to a coolant flow 84 in the chamber 60. This avoids or reduces impingement cross-flow interference. Alternate rows of impingement holes 70 may be offset from each other for this purpose, as shown. The convection cooling zone 64 may have alternating shorter fins 77A and longer fins 77B. The shorter fins may start farther from the impingement cooling zone than the longer fins or have other arrangements. Pins or other shapes may be used together with or in lieu of fins in other embodiments. This provides more heat-transfer surface area closer to the film cooling zone than toward the impingement cooling zone, resulting in more uniform cooling despite warming of the coolant as it flows through the convection zone. The film cooling holes 78 may be optimally spaced widthwise for conductive/convective cooling and for uniform lateral coverage of the coolant film 79. Turbulators (not shown) may be used within the convection cooling zone 64 to improve mixing of the fluid for improved cooling in that zone. Flow conditioner(s) or regulator(s) (not shown) may be used at the entrance and/or exit of the convection cooling zone 64 to achieve a desired pressure setting.

Figure 8:
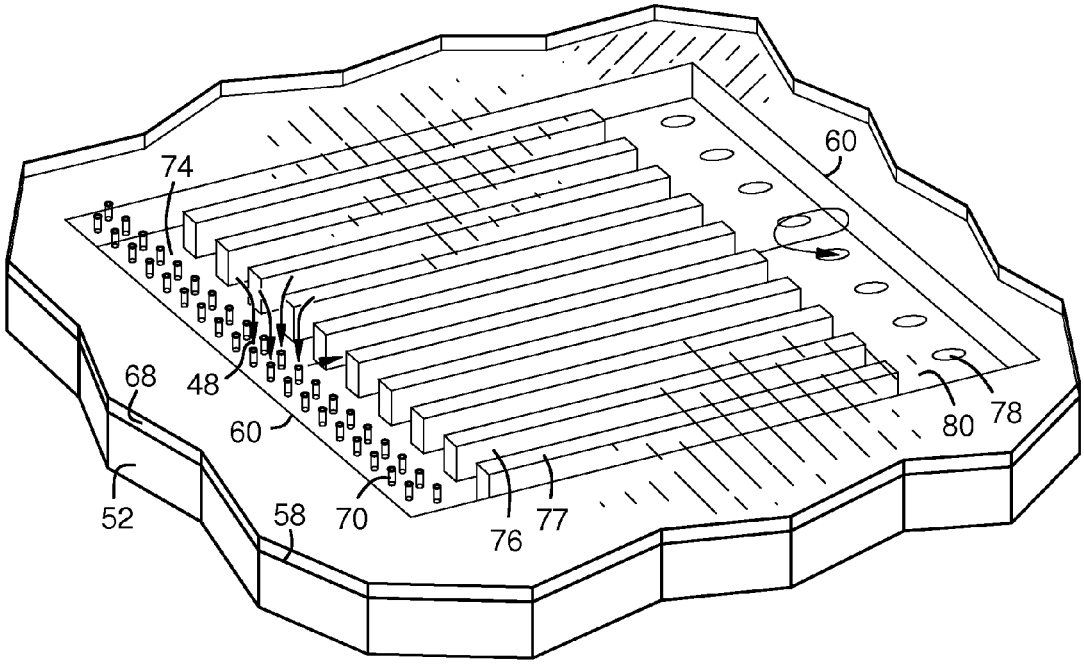
FIG. 8 is a perspective view of a cooling chamber, with cover plate in transparent view.

FIG. 8 is a perspective view of a cooling chamber 60 with a cover plate 68 in transparent view with impingement holes 70. The chambers and fins may be formed by any known process, such as micro-channel fabrication techniques, including casting with chamber-forming cores, sheet fabrication with photo-chemical etching, electrical discharge machining, and laser micro drilling. The cover plate 68 may be bonded to the wall 52 by any known process, such as metal diffusion bonding.

Figure 9:
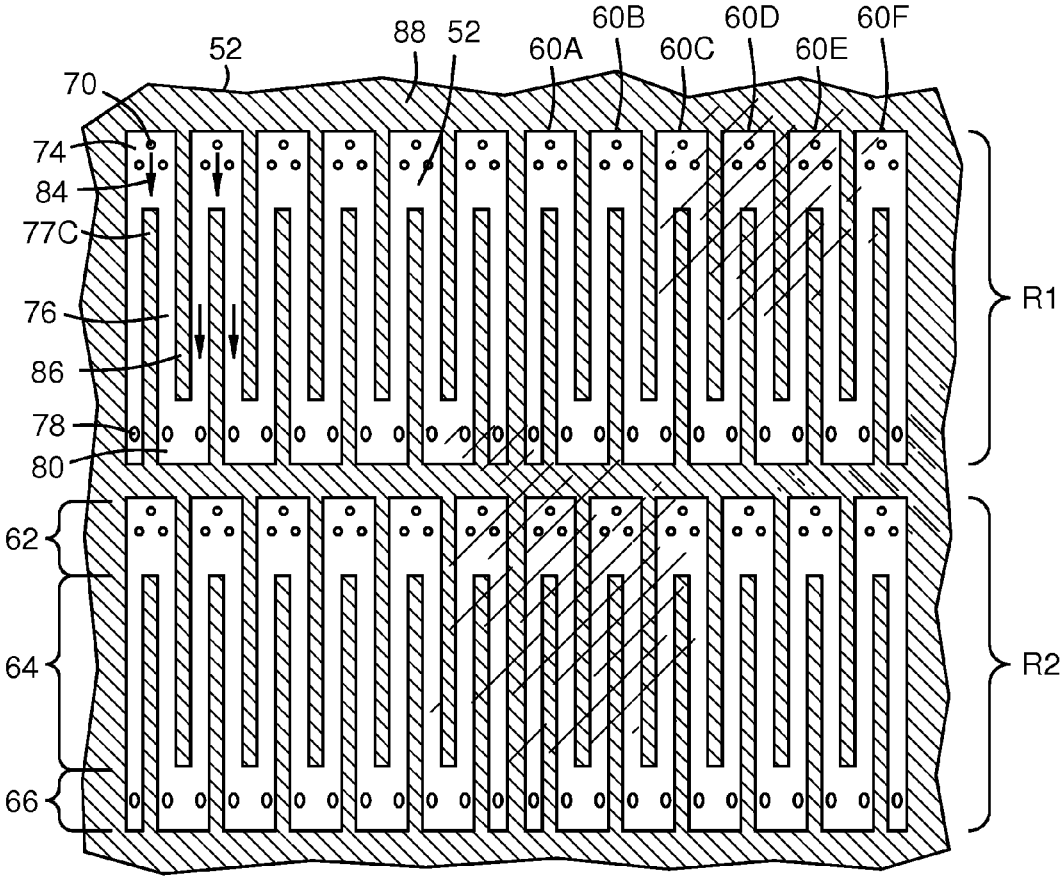
FIG. 9 is a top view of another embodiment, with transparent view of cover plate.

FIG. 9 is a top view of a panel of cooling chambers in two rows R1, R2 as if viewed through a transparent cover plate with impingement holes 70. This embodiment may have laterally adjacent cooling chambers 60A-60F, in which each chamber has an impingement plenum 74, and shares a film cooling plenum 80 with an adjacent chamber 60A-60F. A fin 77C extends into each chamber from the downstream end of the film cooling plenum 80. The sidewall 86 of each chamber may stop short of the downstream end of the film cooling plenum 80, thus allowing the film cooling plenum to be shared by two adjacent chambers, although this is not essential. In any case, the chamber sidewalls 86 and the fins 77C of this embodiment are continuous with a middle layer 88 (hatched) between the turbine component wall 52 (indicated below the transparent cover) and the cover. This middle layer 88 can be formed by a cutting technique such as a water jet cutting, and then bonded to the wall 52, for example by metal diffusion. Thus, the cooling chamber features do not need to be machined, molded, or etched, directly into the wall 52, but can be applied by layering.

Efficiencies of different cooling techniques and devices may be compared based on the percentage of compressor air 48 required to meet a given cooling specification. The higher this percentage, the less air is available for the useful work of combustion, and the lower is the engine efficiency. Various cooling techniques and combinations were evaluated by the inventors, and they found that the present combination provides the highest efficiency of those tested. It reduced cooling air use by over 50% compared to film cooling alone. This was an unexpectedly high improvement.

The present invention advantageously provides the component designer with previously unavailable options for designing an optimal cooling scheme because the functionality of the various cooling zones can be configured independently of each other. For example, the use of an impingement cooling plenum 74 for receiving and collecting the combined impingement jet flows 72 allows the number, location, size and arrangement of the impingement holes 70 to be selected independently of other downstream features. The impingement cooling plenum 74 then feeds coolant to multiple channels 76, the number, size and features of which can be configured independent of each other and independent of the upstream and downstream structures. The convection cooling zone 64 channels then feed the film cooling plenum 80, which allows the number, size and arrangement of the film cooling holes 78 to be configured independently of all other upstream structures. In combination, the present invention makes use of three independently configurable cooling mechanisms to provide an integrated cooling arrangement that exceeds the cooling efficiency of known cooling arrangements.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine component comprising a wall having a combustion gas on a first side of the wall and a coolant gas on an opposed second side of the wall, wherein the coolant gas has a higher pressure than the combustion gas, the component characterized by:

a chamber in the wall, the chamber enclosed by side and end surfaces and a cover plate, the chamber comprising an impingement cooling zone, a film cooling zone, and a convection cooling zone there between;

the impingement cooling zone comprising a plurality of impingement holes that admit and direct jets of the coolant gas into an impingement cooling plenum to impinge against the wall within the impingement cooling zone;

the convection cooling zone comprising a plurality of heat-transfer elements that increase a surface area of the wall exposed to the coolant gas in the convection cooling zone; and the film cooling zone comprising a film cooling plenum receiving the coolant gas from the convection cooling zone and a plurality of film cooling holes between the film cooling zone and the first side of the wall that direct a film of the coolant gas along the first side of the wall;

wherein a flow of the coolant gas follows a continuous path from the impingement holes into the impingement cooling plenum, thence through the convection cooling zone to the film cooling plenum, thence to the film cooling holes, and thence along the first side of the turbine component wall;

wherein the impingement cooling plenum defines a single outflow direction for the coolant gas flow going into the convection cooling zone; and wherein the convection cooling zone comprises metering of the coolant gas that produces a coolant pressure drop between the impingement cooling plenum and the film cooling plenum.

2. A plurality of rows of chambers formed according to claim 1 in the turbine component wall, wherein each of the chambers is oriented with the impingement cooling zone upstream and the film cooling zone downstream relative to a flow direction of the combustion gas, and further comprising a row of additional film cooling holes upstream of the plurality of rows of chambers, wherein an additional film of the coolant gas covers the first side of the wall over a first upstream row of the chambers.

3. A plurality of rows of chambers formed according to claim 1 in the turbine component wall, wherein each of the chambers is oriented with the impingement cooling zone downstream and the film cooling zone upstream relative to a flow direction of the combustion gas, wherein the coolant gas flows through each chamber in a direction opposite to the flow direction of the combustion gas, then exits the film cooling holes and passes over the first side of the wall opposite the chamber.

4. The turbine component of claim 3, wherein for each chamber, a first cooling rate profile of the coolant gas in the chamber has a maximum at the impingement zone, and a second cooling rate profile of the coolant film has a maximum at the film cooling zone, wherein the first and second cooling rate profiles complement each other across the respective first and second sides of the wall over each chamber to provide a combined cooling rate more equalized along the flow direction of the combustion gas than either of the first or second cooling rate profiles.

5. The turbine component of claim 1, wherein the convection cooling zone comprises a plurality of alternating fins and channels that channel the coolant gas between the impingement cooling zone and the film cooling zone.

6. The turbine component of claim 5, wherein the fins are each elongated in a direction of the coolant gas flow, and are not all of an equal length in the direction of the coolant gas flow.

7. The turbine component of claim 1, wherein the heat transfer elements provide a greater amount of surface area closer to the film cooling zone than toward the impingement cooling zone.

8. The turbine component of claim 7, wherein the heat transfer elements comprise a plurality of alternating shorter and longer fins, wherein the shorter fins start farther from the impingement cooling zone than the longer fins.

9. A plurality of rows of chambers formed according to claim 1 in the turbine component wall, wherein the wall forms a transition duct between a compressor and a turbine section of a gas turbine.

10. The turbine component of claim 1, wherein the heat transfer elements comprise elongated fins that extend into the convection cooling zone from an end surface of the chamber at a downstream end of the film cooling plenum, forming channels in the convection cooling zone.

11. A cooling arrangement for a turbine component wall with a combustion gas on a first side of the wall and a coolant gas on an opposed second side of the wall, wherein the coolant gas has a higher pressure than the combustion gas, the cooling arrangement comprising:

a chamber in the wall, the chamber enclosed by side and end surfaces and a cover plate, the chamber comprising an impingement cooling plenum, a film cooling plenum, and a plurality of heat transfer elements forming a convection zone there between;

a plurality of impingement holes through the cover plate that admit and direct jets of the coolant gas to impinge against the wall within the impingement cooling plenum; and a plurality of film cooling holes through the wall between the film cooling plenum and the first side of the wall that direct a film of the coolant gas along the first side of the wall;

wherein a flow of the coolant gas follows a continuous path from the impingement holes to the impingement cooling plenum, thence among the heat transfer elements to the film cooling plenum, thence to the film cooling holes, and thence along the first side of the turbine component wall;

wherein the impingement cooling plenum defines a single outflow direction for the coolant gas flow to the convection zone; and wherein the convection cooling zone comprises metering of the coolant gas that produces a coolant pressure drop between the impingement cooling plenum and the film cooling plenum and the film cooling holes provide further metering, producing four pressure zones wherein the pressure of the coolant gas is higher than a pressure in the impingement plenum, which in turn is higher than a pressure in the film cooling plenum, which in turn is higher than the pressure of the combustion gas.

12. A plurality of rows of chambers formed according to claim 11 in the turbine component wall, wherein each of the chambers is oriented with the impingement cooling plenum upstream and the film cooling plenum downstream, relative to a flow direction of the combustion gas, and further comprising a row of additional film cooling holes upstream of the plurality of rows of chambers, wherein an additional film of the coolant gas covers the first side of the wall over a first upstream row of the chambers.

13. The cooling arrangement of claim 11, wherein the impingement cooling plenum is downstream and the film cooling plenum is upstream, relative to a flow direction of the combustion gas, wherein the coolant gas flows through the chamber in a direction opposite to the flow direction of the combustion gas, then exits the film cooling holes and passes over the first side of the wall opposite the chamber.

14. The cooling arrangement of claim 13, wherein a first cooling rate profile of the coolant gas in the chamber has a maximum at the impingement plenum, and a second cooling rate profile of the coolant film has a maximum at the film cooling plenum, wherein the first and second cooling rate profiles complement each other across the respective first and second sides of the wall in the flow direction of the combustion gas over a length of the chamber, providing a combined cooling rate profile that is more uniform than either the first or second cooling rate profiles.

15. The cooling arrangement of claim 11, wherein the heat transfer elements comprises a plurality of alternating fins and channels that route the coolant gas between the impingement cooling plenum and the film cooling plenum.

16. The cooling arrangement of claim 15, wherein the impingement holes are not within the channels.

17. The cooling arrangement of claim 11, wherein the heat transfer elements provide a greater amount of surface area closer to the film cooling plenum than toward the impingement cooling plenum.

18. The cooling arrangement of claim 17, wherein the heat transfer elements comprise a plurality of alternating shorter and longer fins, wherein the shorter fins start farther from the impingement cooling plenum than the longer fins.

19. A plurality of rows of chambers formed according to claim 11 in the turbine component wall, wherein the wall forms a transition duct between a compressor and a turbine section of a gas turbine.

20. The cooling arrangement of claim 11, wherein the heat transfer elements comprise a plurality of parallel walls and fins extending alternately from respective upstream and downstream end surfaces of the chamber with respect to a coolant flow within the chamber, wherein the upstream walls do not reach the downstream end surface of the chamber, leaving space for the film cooling zone, and the downstream fins do not reach the upstream end surface of the chamber, leaving space for the impingement cooling zone, wherein the parallel walls and fins are elongated in the direction of the coolant flow.

* * * * *